United States Patent [19]

Deffenbaugh

[11] Patent Number: 4,784,339

[45] Date of Patent: Nov. 15, 1988

[54] IMPELLER SHOE FOR IMPACT CRUSHER

[75] Inventor: Robert W. Deffenbaugh, Vancouver, Wash.

[73] Assignee: Columbia Steel Casting Company, Portland, Oreg.

[21] Appl. No.: 67,371

[22] Filed: Jun. 29, 1987

[51] Int. Cl.[4] ..... B02C 19/00

[52] U.S. Cl. ..... 241/275

[58] Field of Search ..... 51/434, 435; 416/235, 416/237; 241/275, DIG. 10

[56] References Cited

U.S. PATENT DOCUMENTS

| | | | |
|---|---|---|---|
| 3,058,679 | 10/1962 | Adams | 241/275 |
| 4,069,025 | 1/1978 | MacMillan | 51/434 |
| 4,174,814 | 11/1979 | Warren et al. | 241/275 |
| 4,277,965 | 7/1981 | Rutten | 51/435 X |

*Primary Examiner*—Mark Rosenbaum

*Attorney, Agent, or Firm*—Owen, Wickersham and Erickson

[57] ABSTRACT

An impeller shoe for a centrifugal rock crushing machine comprises an elongated body of wear resistant alloy material having a generally trapeziform shape with a back bearing surface on one side and a working front face extending longitudinally on its other side. The front face has a plurality of adjacent exterior surfaces, each surface forming a different acute angle with respect to the back bearing surface. The impeller shoe is adapted to be retained by a bracket on a horizontal turntable of the rock crushing machine to propel aggregate striking the front face to an anvil spaced outwardly from the turntable. The multiple exterior sections of the working front face in use produces a progressively wear pattern along its length that is substantial uniform in depth.

4 Claims, 2 Drawing Sheets

IMPELLER SHOE FOR IMPACT CRUSHER

This invention relates to centrifugal impact rock crusher machines and more particularly to an improved impeller shoe for such machines

BACKGROUND OF THE INVENTION

Centrifugal impact rock crushing machines, also known as vertical shaft impact crushers, operate to crush rock by propelling it at high speeds against an anvil, or against other rock which has accumulated inside the crushing chamber. In such machines larger rock material is fed through a vertical feed tube onto the center of a rotating table or enclosed rotor having a series of impeller shoes which accelerate and sling the material radially outwardly at a high velocity against stationary wear-resistant anvils spaced around the rotating table. The force of the rock hitting the anvils causes the rock to break along its crystalline planes to form an aggregate of more or less uniform size.

In impact crushers heretofore devised excessive wear of the impeller shoes become a difficult problem due to the stresses and friction created by the rock as it is forced to slide over the working face on one side of each impeller shoe. Such wear made it necessary to stop the crusher machines more often to replace worn out shoes, thereby reducing overall production efficiency.

A significant aspect of the wear problem on standard impeller shoes heretofore devised was that the wear pattern on the impeller shoe face was not uniform. An example of a prior art impeller shoe is shown in U.S Pat. No. 4,174,814. with such prior art impeller shoes, the working face across which the rock moved was a single planar surface. In use, wear or erosion of metal on this planar surface occurred at a faster rate at its thick end, resulting in a decrease in the face angle of the shoe with respect to a radius of its rotating table. This decrease in face angle also had the undesirable effect of decreasing crushing efficiency and production.

Accordingly, one principal object of the invention is to provide an improved impeller shoe for an impact crusher that will wear more evenly and uniformly along its front aggregate contacting or working face and thus have a longer useful life.

Another object of the invention is to provide an improved impeller shoe for an impact crusher whose working face angle will remain substantially the same as it normally wear during its useful life.

Still another object of the invention is to provide an impeller shoe for an impact crusher which will have greater wearability and will maintain crushing productivity during its life.

SUMMARY OF THE INVENTION

The aforesaid objectives of the invention are accomplished by an impeller shoe adapted to be removably connected to a rotating table and having a front face that engages a constantly moving stream of rock before propelling it radially against an anvil spaced outwardly from the table. In contrast to prior impeller shoes for such impact crushers having a single wear face angle, the present invention provides an impeller with a wear face having multiple working face sectors with different angles. In general, the innermost sector (closest to the rotating table center) has the greatest angle with respect to a radius from the table center. An adjacent outer face sector on the impeller has a smaller angle because the speed of the rock passing over it, and thus the wearing stress on this working face, is greater in the outer sector. By varying the relative angles and sizes of the wear face sectors, a substantially uniform wear pattern over the entire impeller wear face can be obtained. This not only increases the useful life of the impeller show but also causes the impact crusher machine to use power more efficiently and on a more consistent basis during its useful life.

Other objects, advantages and features of the invention will become apparent from the following detailed description, taken in conjunction with the accompanying drawing.

DETAILED DESCRIPTION OF EMBODIMENTS

Figure 1:
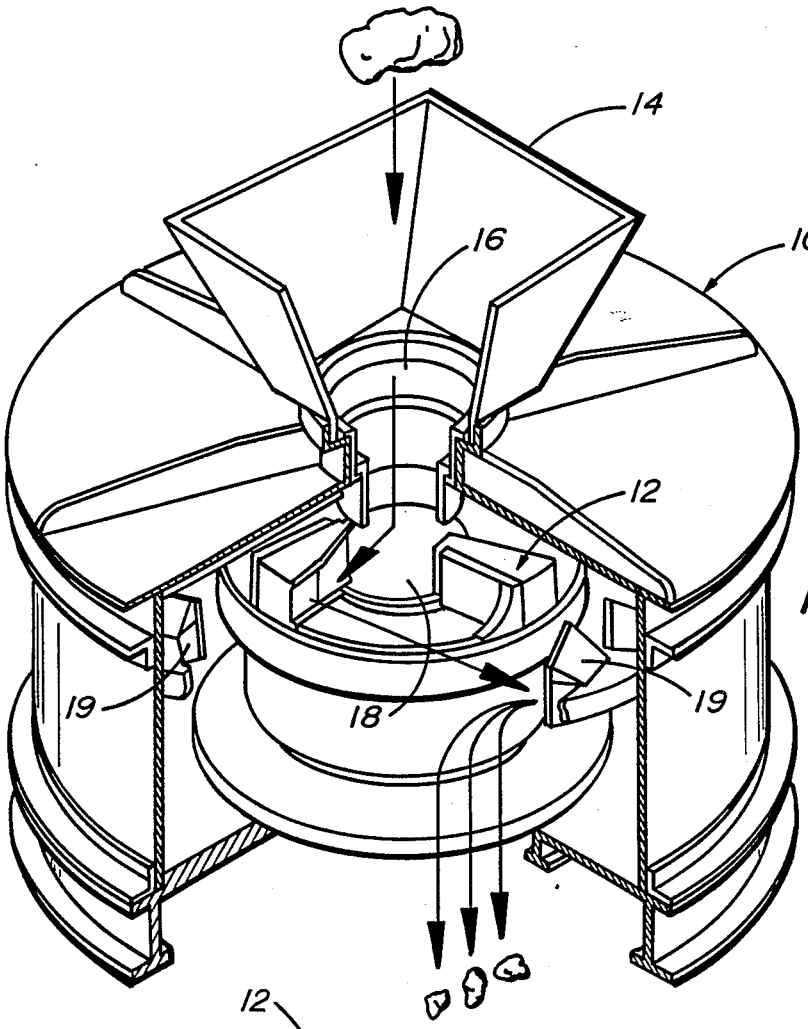
FIG. 1 is a fragmentary view in perspective of an impact crusher machine utilizing a series of impeller shoes according to the invention.

With reference to the drawing, FIG. 1 shows diagrammatically a typial vertical shaft impact crusher 10 utilizing an impeller shoe 12 embodying principles of the present invention. In general, such a crusher comprises an input hopper 14 which feeds relatively large rock through a vertical feed tube 16 into the center of a rotating table 18 or enclosed rotor having impeller shoes 12 fixed thereon that accelerate and sling the rock material outward by centrifugal force. The material strikes an encircling ring of anvils 19 spaced outwardly from the impeller, fractures, and falls out the bottom of the crushing chamber. Due to the continuous impact force of the high velocity rock which impinges against them, the impeller shoes 12 tend to wear rapidly and must be replaced periodically during the life of the crusher machine. In accordance with the present invention the impeller shoes 12 are constructed to wear in a relatively uniform manner so as to provide a long life and service before requiring replacement.

Figure 2:
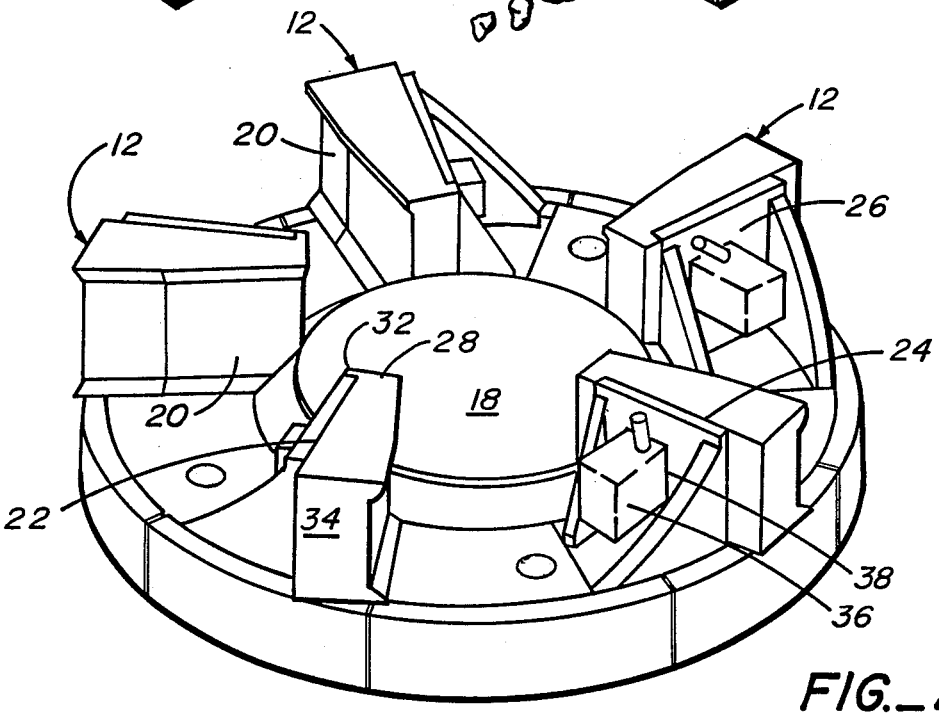
FIG. 2 is an enlarged view in perspective of a rotating table for the impact crusher of FIG. 1, with impeller shoes attached thereto.

As shown in FIG. 2, each impeller shoe 12 comprises generally a one-piece wear resistant metal alloy body having an elongated trapeziform shape with a front working surface 20 which receives the striking rock fragments and a back or rear bearing surface 22. The rear surface of each shoe 12 is generally planar and fits against a similarly planar mounting surface 24 of one of a series of upright circumferentially spaced apart support brackets 26 that are attached to the upper side of the crusher table 18. These support brackets are arranged on the table 18 so that their mounting surfaces 24 extend generally radially from its center.

The inner end of each impeller shoe body has an end surface 28 which, in plan view, forms an acute angle of around 80° with a back bearing surface 22. At its inner end, the impeller shoe has a wing portion 32 that extends outwardly from the back bearing surface for protecting the inner edge of the turnable bracket 26. At the outer larger end of the impeller shoe body is an outer end surface 34 which forms an angle of around 80° with the back bearing surface 22.

Extending from the rear surface of each impeller shoe is a boss member 36 that is adapted to extend through a slightly larger hole 38 in a support bracket. When the rear bearing surface 22 of an impeller shoe 12 is flush against the mounting surface 24 of a support bracket 26, with the impeller's boss member 36 extending through the bracket hole, a retaining pin 40 is placed through the boss member to secure the impeller shoe in place on its support bracket.

Figure 3:
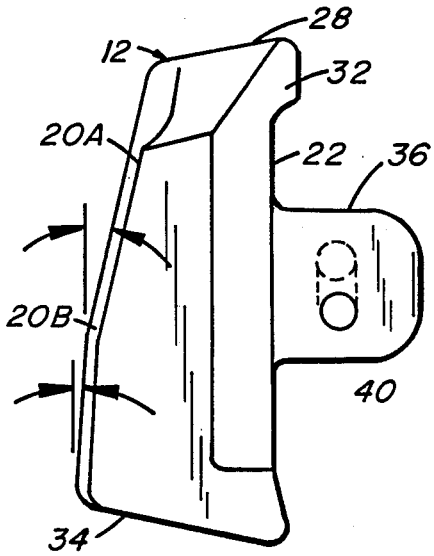
FIG. 3 is a top view of an impeller shoe according to the invention.
Figure 4:
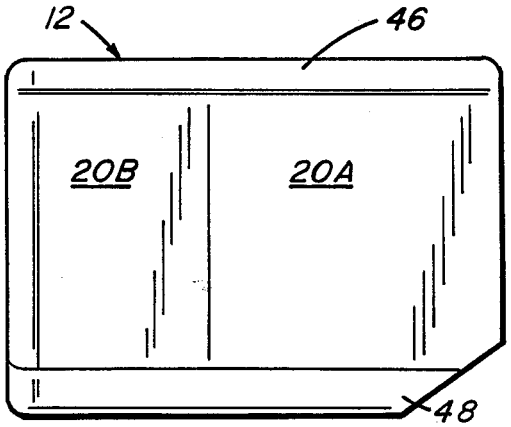
FIG. 4 is a front side view of the impeller shoe of FIG. 1.
Figure 5:
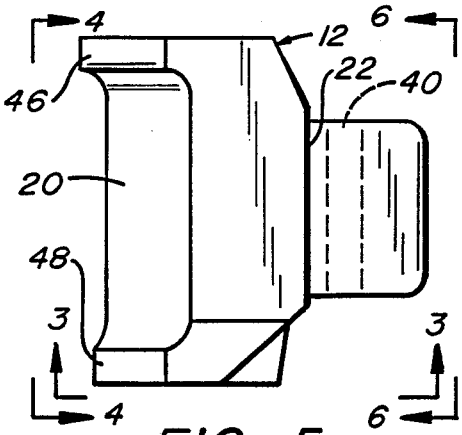
FIG. 5 is an end side view of the impeller shoe of FIG. 1.
Figure 6:
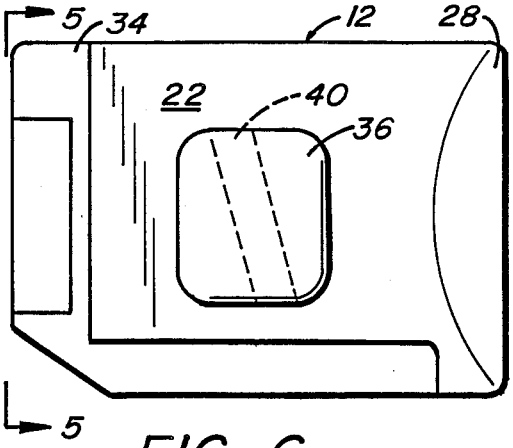
FIG. 6 is a rear side view of the impeller shoe of FIG. 1.

The impeller shoe 12, in accordance with the invention, is provided with a configuration that enables its front working face to wear generally uniformly along its length, thereby increasing the overall useful life of the impeller. A shown in FIGS. 3 and 4, the impeller shoe 12 has a working face 20 with face sections 20A and 20B that form different angles relative to a line that is parallel to its back mounting or bearing 22 surface and also a radius from the center of the table. The first or inner face section 20A which is closest to the center of the table 16, has a greater angle relative to the mounting surface (e.g. 14°) than the second face section 20B which extends outwardly from the first section and has an angle of around 4°.

Figure 7:
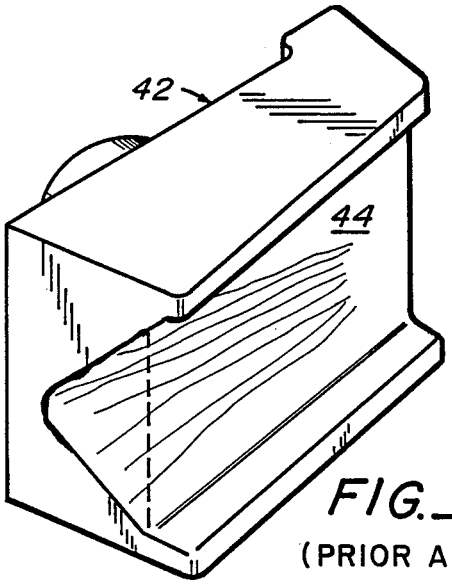
FIG. 7 (PRIOR ART)
FIG. 7 is a view in perspective showing a typical wear pattern for an impeller shoe having a single angle face.
Figure 8:
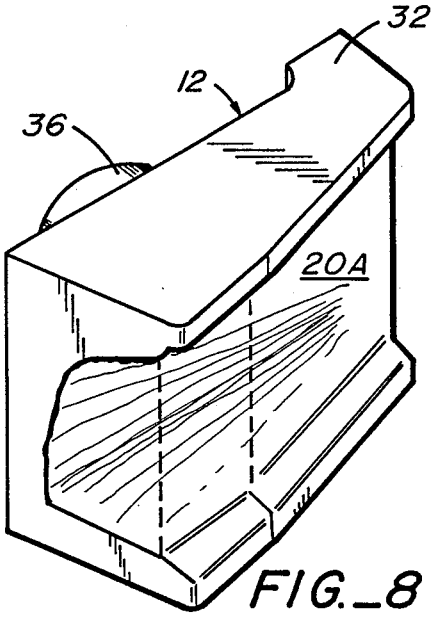
FIG. 8 is a view in perspective showing a typical wear pattern for an impeller shoe with a multi-angle face according to the invention.

By using the multi-angle working face 20 in the impeller shoe 12, the wear pattern that develops over a period of use on a crusher is considerably better than for an impeller shoe having a single angle face. This is illustrated in comparative FIGS. 7 and 8 which show typical wear patterns that occur in an impeller shoe 12 with multi-angle face sections 20 and an impeller shoe 42 of the prior art having a single angle working face 44. The latter standard impeller shoe tends to wear at a faster rate at its thick end, resulting in a gradual decrease in face angle as the impeller shoe is used. This premature increased wear causes a decrease in power draw on the crusher which in turn slows its production rate. As shown in FIG. 8, the multi-angle impeller shoe 12 wears differently with the wear erosion being distributed more evenly over the entire shoe face. Particularly after the first 20% of its normal running life, the expected decrease in power draw and thus the reduction in production capacity of an impeller shoe 12 having multi-angle working face 20 is substantially less than that of the conventional single angle impeller shoe.

As shown in FIGS. 3 to 6, the impeller shoe 12 is provided with integral lip or flange portions 46 and 48 extending outwardly from the impeller shoe body along the upper and lower edges of the multi-angle working face 20. These flange portions serve as guides for the rock that strikes and moves along the working face before being propelled against an anvil. In order to prevent any rock from passing over the upper flange and possibly striking the next adjacent impeller shoe on the table, the upper flange portion 46 is larger, that is, it extends farther out from the working face than the lower flange portion 48. For example, the upper flange portion may extend $\frac{5}{8}$ inches from the working force whereas the lower flange portion extends outwardly only $\frac{3}{8}$ inches.

Although the impeller shoe 12 represents a preferred form of the invention having the working surface 20 with the two sections 20A nd 20B of different angles, a working surface with three sections having diffenent angles could also be used. As with the shoe 12, the innermost surface would have the greatest angle with respect to the bearing face (17°), middle section would have a somewhat less angle (13°) and the outermost surface would have an even smaller angle (8°). The aforesaid three surface version of an impeller shoe is not illustrated, but aside from its working surface of these sectors, it would in all other respects be the same as the impeller shoe 12.

For either form of the impeller shoe according to the invention, its multi-section working surface provides a wear pattern that is essentially constant and uniform along the length of the impeller shoe body as shown in FIG. 8. This improved relatively uniform wear pattern extends the useful life to the impeller shoe 12 and causes the crusher itself to operate more consistantly and efficiently. The improved wear pattern on the multi-angle working surface 20 is due largely to the fact that the rock striking the impeller surface accelerates as it moves outwardly across the wear face. By decreasing the angle of the face relative to the impact path of the moving rock and outwardly on the face, in accordance with the invention, the abrasive pressure of the rock on the face becomes more uniform over the entire length of hte impeller shoe face, that is, along both surfaces 20A and 20B. This results in the more uniform wear pattern of FIG. 8, rather than the deeper pattern that normally occured in the prior art single surface shoe, as shown in FIG. 7.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. An elongated impeller shoe for mounting to a bracket on a horizontal turntable of a vertical axis centrifugal rock crushing machine to accelerate aggregate radially outward from a central distribution cone to impact against stationary anvils to thereby crush the aggregate, said impeller shoe comprising:

an elongated body of wear resistant alloy material extending longitudinally from an inner end to an outer end;

said body having a generally trapeziform shape with a back bearing surface on one side extending longitudinally between the inner end and the outer end and adapted to bear against a said turntable bracket, a working front face extending longitudinally between upper and lower longitudinal channel lips from the inner end to the outer end, said front face having a plurality of adjacent exterior surfaces that each extend from the upper channel lip to the lower channel lip, each surface being adapted to lie substantially in a plane that is perpendicular to the plane of said turntable when said impeller shoe is mounted properly thereon and each surface forming a different acute angle with respect to said back bearing surface, the angles said exterior surfaces form with respect to said back bearing surface decreasing from the inner end to the outer end, and said exterior surfaces being adapted for receiving and directing aggregate therealong, an outer end surface extending transversely between the outer end of one working front face surface to the back bearing surface, and an inner end surface extending transversely between the inner end of another front face surface and the back bearing surface;

whereby said working front face in use produces a progressive wear pattern along its length that is substantially uniform in depth.

2. The impeller shoe as described in claim 1 wherein said working front face is comprised of two adjacent surfaces including an innermost surface which terminates at said inner end surface and an outermost surface which terminates at said outer end surface, said innermost surface forming an angle with said back bearing surface which is greater than the angle formed by said outermost surface with said back bearing surface.

3. The impeller shoe as described in claim 2 wherein said angle formed by said innermost surface and said back bearing surface is around 14° and said angle formed by said outermost surface and said back bearing surface is around 4°.

4. The impeller shoe as described in claim 1 wherein said upper longitudinal channel lip extends further out from said working face along its length than said lower longitudinal channel lip.

* * * * *